US011633828B2

(12) United States Patent
Suzuki et al.

(10) Patent No.: US 11,633,828 B2
(45) Date of Patent: Apr. 25, 2023

(54) SUBSTRATE POLISHING SYSTEM, SUBSTRATE POLISHING METHOD AND SUBSTRATE POLISHING APPARATUS

(71) Applicant: EBARA CORPORATION, Tokyo (JP)

(72) Inventors: Yuta Suzuki, Tokyo (JP); Taro Takahashi, Tokyo (JP); Akihiko Ogawa, Tokyo (JP); Shigeyuki Furuya, Tokyo (JP); Yuji Yagi, Tokyo (JP); Nobuyuki Takada, Tokyo (JP); Shinpei Tokunaga, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 317 days.

(21) Appl. No.: 16/797,316

(22) Filed: Feb. 21, 2020

(65) Prior Publication Data

US 2020/0269380 A1 Aug. 27, 2020

(30) Foreign Application Priority Data

Feb. 22, 2019 (JP) ..... JP2019-030179

(51) Int. Cl.
*B24B 37/013* (2012.01)
*B24B 21/04* (2006.01)

(52) U.S. Cl.
CPC ..... *B24B 37/013* (2013.01); *B24B 21/04* (2013.01)

(58) Field of Classification Search
CPC ..... B24B 49/02; B24B 49/04; B24B 49/105; B24B 37/013; B24B 37/005
USPC ..... 451/5, 8, 9, 10, 11, 41, 287
See application file for complete search history.

(56) References Cited

U.S. PATENT DOCUMENTS 8,696,924 B2 4/2014 Tada et al.
2005/0191858 A1* 9/2005 Fukunaga ..... B24B 49/16 451/5
2009/0104847 A1 4/2009 Kobayashi et al.
2013/0065493 A1 3/2013 Takahashi
2013/0337722 A1* 12/2013 Namiki ..... B24B 37/013 451/41
2015/0118765 A1* 4/2015 Xu ..... H01L 21/3212 438/10

(Continued)

FOREIGN PATENT DOCUMENTS

JP 2007-276035 A 10/2007
JP 2009-099842 A 5/2009
JP 2013-036881 A 2/2013

*Primary Examiner* — Joel D Crandall
*Assistant Examiner* — Tyler James McFarland
(74) *Attorney, Agent, or Firm* — BakerHostetler

(57) ABSTRACT

A first and a second substrate polishing apparatus and are provided with a film thickness sensor for measuring a film thickness of layer to be polished and polish the layer by pressing the substrate against a polishing pad. The first substrate polishing apparatus outputs difference between output value of the film thickness sensor when an underlayer is exposed and output value of the film thickness sensor when the substrate is not present, as a first offset value. The second substrate polishing apparatus has a storage unit that stores information of the first offset value, an output correction unit that corrects the output value from the film thickness sensor based on the first offset value, and an end point detection unit that outputs control signal indicating end point of substrate polishing when measured value of the film thickness of the layer calculated based on the corrected output value reaches target value.

8 Claims, 12 Drawing Sheets

(56) References Cited

U.S. PATENT DOCUMENTS

| | | | | |
|---|---|---|---|---|
| 2015/0118766 | A1 | 4/2015 | Xu et al. | |
| 2015/0262893 | A1 | 9/2015 | Nakamura et al. | |
| 2018/0147687 | A1* | 5/2018 | Takahashi | B24B 37/013 |

* cited by examiner

SUBSTRATE POLISHING SYSTEM, SUBSTRATE POLISHING METHOD AND SUBSTRATE POLISHING APPARATUS

CROSS REFERENCE TO RELATED APPLICATIONS

This application claims the benefit of Japanese Priority Patent Application JP 2019-30179 filed on Feb. 22, 2019, the entire contents of which are incorporated herein by reference.

FIELD OF THE INVENTION

The present invention relates to a system and a method for polishing a surface of a substrate such as a semiconductor wafer, and a substrate polishing apparatus.

BACKGROUND ART

Substrate polishing apparatuses for polishing a surface of a substrate using so-called CMP (Chemical Mechanical Polishing) are widely used to form a semiconductor device having a multilayered wiring structure in which various materials are repeatedly formed in a film shape on a semiconductor wafer. For example, a metal film is formed on a surface of a substrate on which a wiring groove is formed, unnecessary films are then removed by polishing, leaving only the metal film formed in the groove by CMP and metal wiring is thereby formed.

Along with high integration and high density of semiconductor devices, circuit wiring is becoming finer and the number of multilayered wirings is also increasing, and flattening of surfaces of the semiconductor devices in manufacturing steps and accuracy of detection of an interface between a layer to be polished and a base layer are becoming increasingly important. For this reason, it is preferable to accurately measure a film thickness of a substrate being polished in order to appropriately control timing of ending substrate polishing.

For example, an eddy current sensor is widely used as film thickness measuring devices to measure film thicknesses of substrates. With a substrate having a multilayered wiring structure, however, wiring formed in an underlayer of a metal film to be polished affects output signals of an eddy current sensor, which constitutes an obstacle against accurate measurement of film thicknesses.

The smaller an output signal from the eddy current sensor, the smaller is the influence of noise or a pattern of a semiconductor wafer, and the output signal value tends to gradually become smaller as the polishing advances. Therefore, according to a polishing apparatus described in Japanese Patent Laid-Open No. 2007-276035, a predetermined value (representative value) is determined as a threshold and signals larger than the representative value are judged and cut as noise to thereby reduce the influences of noise or the wiring pattern of the underlayer.

In the case of the above polishing apparatus described in Japanese Patent Laid-Open No. 2007-276035, when the signal intensity from the sensor is small, that is, when the polishing advances and the thickness of the remaining film of the layer to be polished is small or substantially nonexistent, it may be possible to reduce the influence of the wiring pattern of the underlayer of the layer to be polished. However, when polishing is preferably stopped at a certain degree of thickness of the remaining film, it cannot be said that the influence of the wiring pattern of the underlayer can be removed effectively.

In a semiconductor process, it is an ordinary practice that substrate polishing is performed a plurality of times, and in such a case, it is preferable that data measured at the time of previously conducted substrate polishing be effectively used for subsequent substrate polishing.

SUMMARY OF THE INVENTION

The present invention has been implemented in view of the above circumstances, and it is an object of the present invention to provide a substrate polishing system and method, and a substrate polishing apparatus that can effectively reduce an influence of a wiring pattern of an underlayer and more accurately detect an end point of substrate polishing.

According to an aspect of the present invention, a substrate polishing system comprising a first substrate polishing apparatus and a second substrate polishing apparatus, each of which comprises a film thickness sensor for measuring a film thickness of a layer to be polished of a substrate and performing polishing the layer to be polished by pressing the substrate against a polishing pad. The first substrate polishing apparatus outputs a difference, as a first offset value, between an output value of the film thickness sensor when an underlayer of the layer to be polished is exposed and an output value of the film thickness sensor when the substrate is not present. The second substrate polishing apparatus comprises a storage unit that stores information of the first offset value, an output correction unit that corrects the output value from the film thickness sensor based on the first offset value, and an end point detection unit that outputs a control signal indicating an end point of substrate polishing when a measured value of the film thickness of the layer to be polished calculated based on the corrected output value reaches a target value.

According to an aspect of the present invention, a substrate polishing method for sequentially polishing layers to be polished using a first substrate polishing apparatus and a second substrate polishing apparatus, each of which comprises a film thickness sensor for measuring a film thickness of the layers to be polished of a substrate and polishing the layers to be polished by pressing the substrate against a polishing pad. The first substrate polishing apparatus outputs a difference, as a first offset value, between an output value of the film thickness sensor when an underlayer of the layer to be polished is exposed and an output value of the film thickness sensor when the substrate is not present. The second substrate polishing apparatus stores information of the first offset value in a storage unit, corrects an output value from the film thickness sensor based on the first offset value, and outputs a control signal indicating an end point of substrate polishing when a measured value of the film thickness of each of the layers to be polished calculated based on the corrected output value reaches a target value.

According to an aspect of the present invention, a substrate polishing apparatus comprises a polishing head for polishing a layer to be polished by pressing a substrate comprising the layer to be polished against a polishing pad, a film thickness sensor for measuring a film thickness of the layer to be polished, a storage unit that stores therein information indicating a difference, as a first offset value, between an output value of the film thickness sensor when an underlayer of the layer to be polished is exposed and an output value of the film thickness sensor when the substrate is not present in past polishing of the layer to be polished, an output correction unit that corrects the output value from the film thickness sensor based on the first offset value, and an end point detection unit that outputs a control signal indicating an end point of substrate polishing when a measured value of the film thickness of the layer to be polished based on the corrected output value reaches a target value.

DETAILED DESCRIPTION OF PREFERRED EMBODIMENTS

Figure 1:
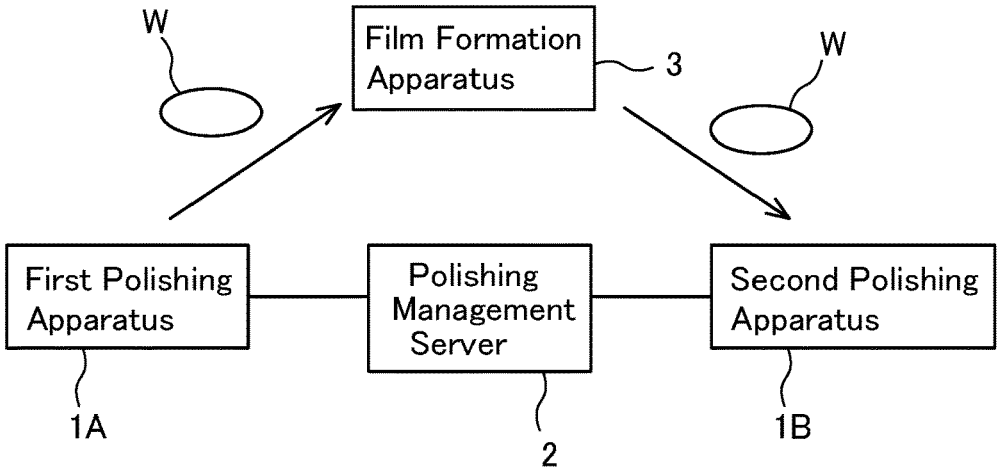
FIG. 1 is an explanatory drawing schematically illustrating a configuration of a substrate polishing system according to an embodiment of the present invention.

Hereinafter, an embodiment of the present invention will be described with reference to the accompanying drawings. Note that identical or corresponding components are assigned identical reference numerals and duplicate description will be omitted.

Figure 2:
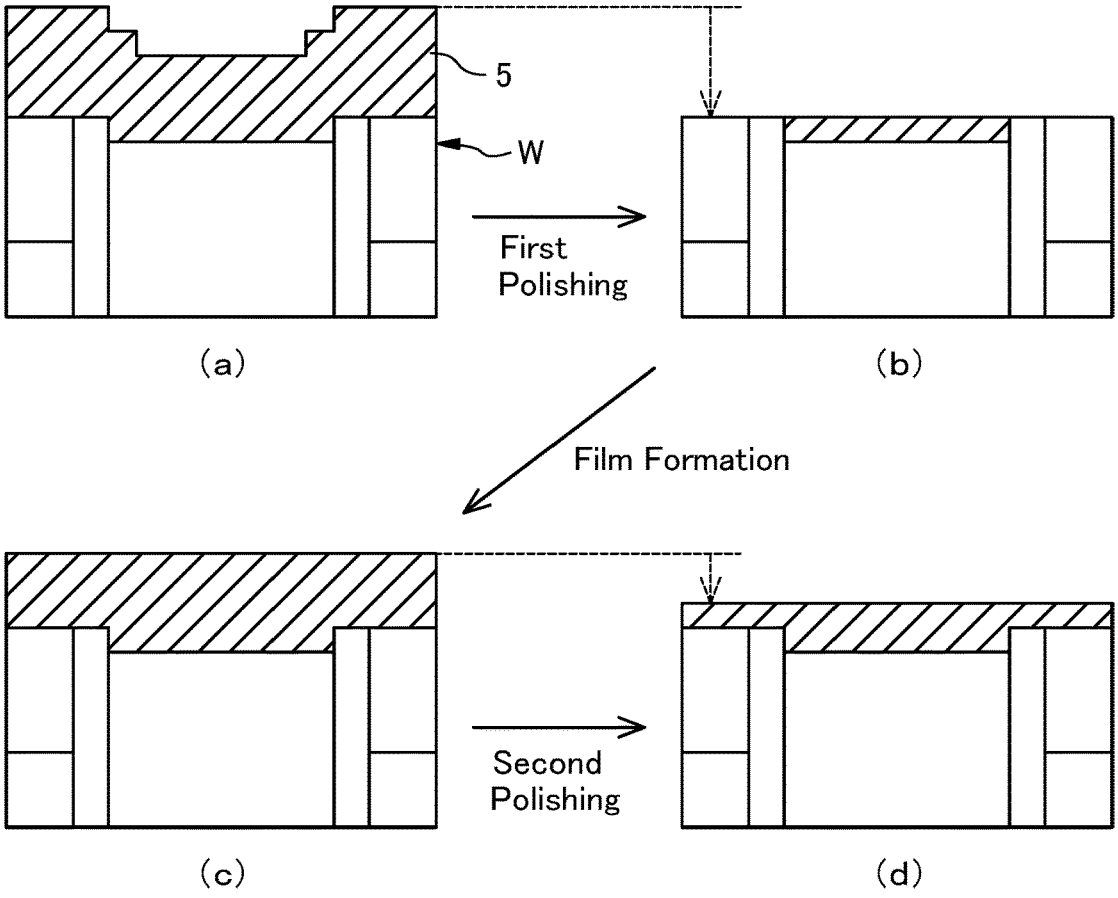
FIG. 2 is an explanatory drawing illustrating an example of a semiconductor process including substrate polishing.

FIG. 1 illustrates a polishing system according to an embodiment of the present invention. In FIG. 1, a first polishing apparatus 1A and a second polishing apparatus 1B are connected to a polishing management server 2 and transmit/receive various kinds of data such as identification information (lot ID, wafer number) of a wafer (substrate) W to be polished and offset information used to correct sensor output, which will be described later. FIG. 2 is an explanatory drawing illustrating an example of a wafer polishing process, and a layer to be polished 5 (metal layer such as TiN; shaded area in FIG. 2(*a*)) formed on a wafer W is polished by the first polishing apparatus 1A until an underlayer is exposed (FIG. 2(*b*)). After that, the wafer W is conveyed to a film formation apparatus 3, a metal layer which is a layer to be polished is formed (FIG. 2(*c*)), then conveyed to the second polishing apparatus 1B and the layer to be polished 5 is polished to obtain a desired film thickness (FIG. 2(*d*)).

Figure 3:
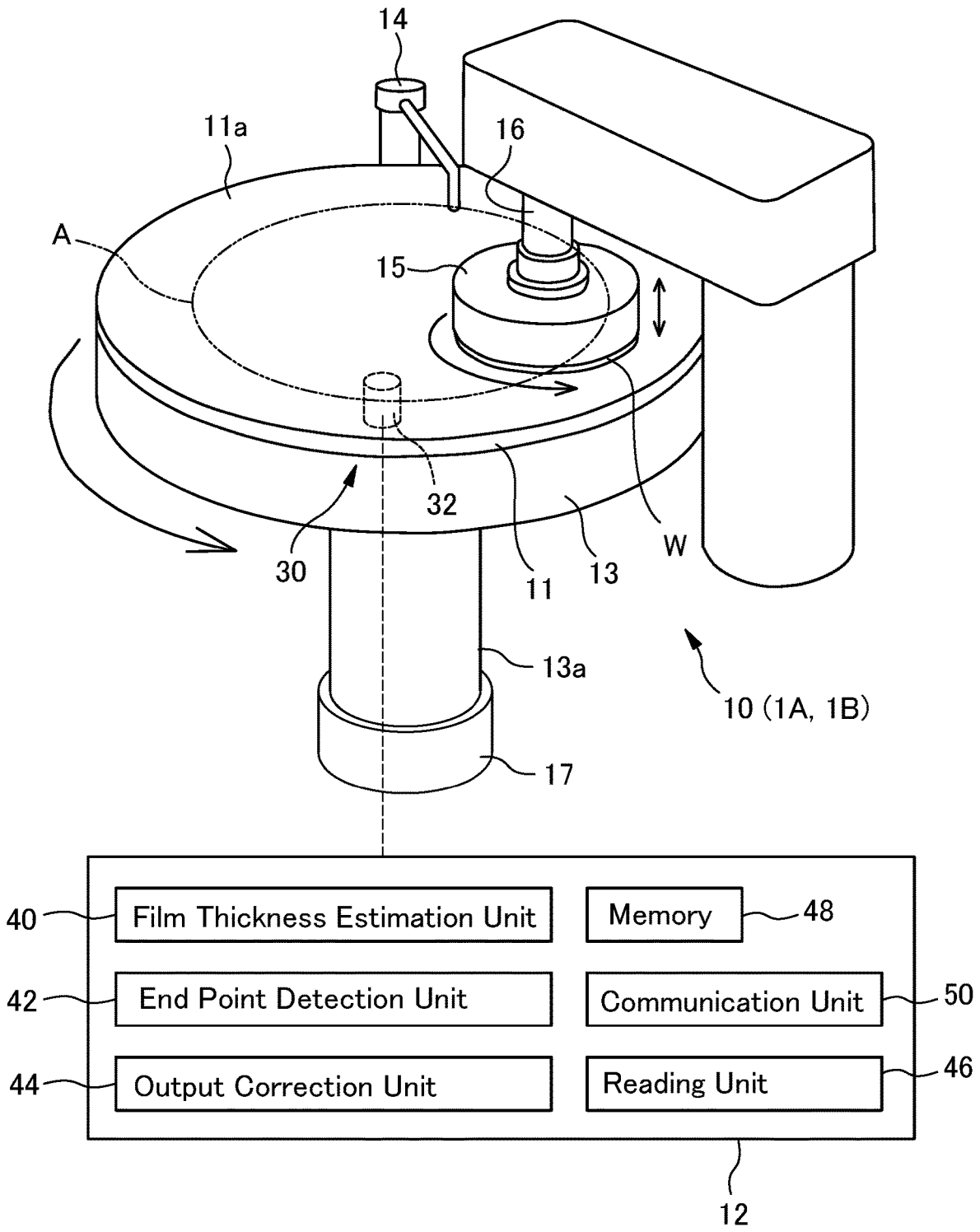
FIG. 3 is a perspective view schematically illustrating a configuration of a substrate polishing apparatus.

FIG. 3 schematically illustrates a configuration of a polishing apparatus according to the embodiment of the present invention, and the first polishing apparatus 1A and the second polishing apparatus 1B in FIG. 1 are provided with an identical configuration. A polishing apparatus 10 (1A, 1B) is provided with a polishing table 13 to which a polishing pad 11 having a polishing surface 11*a* is attached, a polishing head (top ring) 15 for holding the wafer W, which is an example of the substrate, and polishing the wafer W while pressing the wafer W against the polishing pad 11 on the polishing table 13, a polishing liquid supply nozzle 14 for supplying a polishing liquid (e.g., slurry) to the polishing pad 11 and a polishing control unit 12 that controls polishing of the wafer W.

The polishing table 13 is connected to a table motor 17 disposed therebelow via a table shaft 13*a* and the table motor 17 causes the polishing table 13 to rotate in a direction shown by an arrow. The polishing pad 11 is pasted to a top surface of the polishing table 13, and a top surface of the polishing pad 11 constitutes the polishing surface 11*a* for polishing the wafer W. The polishing head 15 is connected to a bottom end of a polishing head shaft 16. The polishing head 15 is configured to be able to hold the wafer W to an undersurface thereof by vacuum suction. The polishing head shaft 16 is configured to move up and down by an up-down movement mechanism (not shown).

Polishing of the wafer W is performed as follows. The polishing head 15 and the polishing table 13 are made to rotate in directions shown by respective arrows, and a polishing liquid (slurry) is supplied from the polishing liquid supply nozzle 14 to the polishing pad 11. In this condition, the polishing head 15 presses the wafer W against the polishing surface 11*a* of the polishing pad 11. The surface of the wafer W is polished by mechanical action of abrasive grains included in the polishing liquid and chemical action of the polishing liquid.

Figure 4:
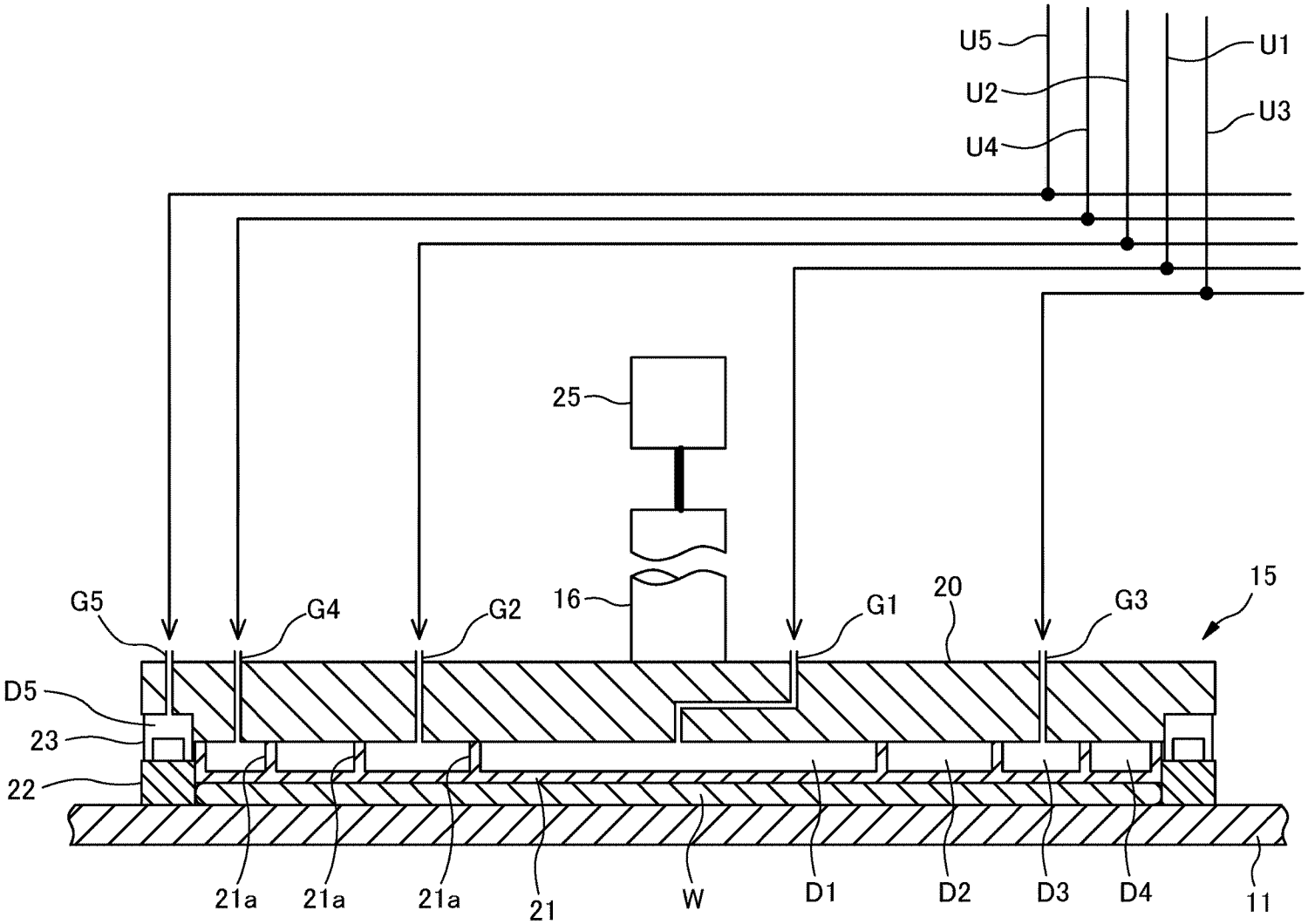
FIG. 4 is a cross-sectional view illustrating a structure of a polishing head.

FIG. 4 is a cross-sectional view illustrating a structure of the polishing head 15. The polishing head 15 is provided with a disk-like carrier 20, a circular flexible elastic film 21 that forms a plurality of pressure chambers (airbags) D1, D2, D3 and D4 below the carrier 20, and a retainer ring 22 disposed so as to surround the wafer W and pressing the polishing pad 11. The pressure chambers D1, D2, D3 and D4 are formed between the elastic film 21 and an undersurface of the carrier 20.

The elastic film 21 includes a plurality of annular partition walls 21*a*, and the pressure chambers D1, D2, D3 and D4 are partitioned by these partition walls 21*a*. The pressure chamber D1 at the center is circular and the other pressure chambers D2, D3 and D4 are annular. These pressure chambers D1, D2, D3 and D4 are arranged concentrically.

The pressure chambers D1, D2, D3 and D4 are connected to fluid lines G1, G2, G3 and G4 and a pressure-adjusted pressurized fluid (e.g., pressurized gas such as pressurized air) is supplied into the pressure chambers D1, D2, D3 and D4 via the fluid lines G1, G2, G3 and G4. Vacuum lines U1, U2, U3 and U4 are connected to the fluid lines G1, G2, G3 and G4, and the vacuum lines U1, U2, U3 and U4 form negative pressures in the pressure chambers D1, D2, D3 and D4.

Inner pressures in the pressure chambers D1, D2, D3 and D4 can be changed independently of one another by a processing unit 32 and the polishing control unit 12, which will be described later, thus making it possible to adjust polishing pressures on four corresponding regions of the wafer W, that is, a central part, an inside intermediate part, an outside intermediate part and a peripheral edge independently of one another.

The annular elastic film 21 is disposed between the retainer ring 22 and the carrier 20. An annular pressure chamber D5 is formed in the elastic film 21. This pressure chamber D5 is connected to a fluid line G5 and a pressure-adjusted pressurized fluid (e.g., pressurized air) is supplied into the pressure chamber D5 via the fluid line G5. The vacuum line U5 is connected to the fluid line G5 and the vacuum line U5 forms a negative pressure in the pressure chamber D5.

As the pressure in the pressure chamber D5 changes, the entire retainer ring 22 moves up and down together with the elastic film 21, and so the pressure in the pressure chamber D5 is added to the retainer ring 22, and the retainer ring 22 is configured to be able to directly press the polishing pad 11 independently of the elastic film 21. During polishing of the wafer W, while the retainer ring 22 is pressing the polishing pad 11 around the wafer W, the elastic film 21 presses the wafer W against the polishing pad 11.

The carrier 20 is fixed to a bottom end of the head shaft 16 and the head shaft 16 is connected to an up-down movement mechanism 25. This up-down movement mechanism 25 is configured to cause the head shaft 16 and the polishing head 15 to move up and down and further cause the polishing head 15 to be positioned at a predetermined height. A combination of a servo motor and a ball screw mechanism is used as the up-down movement mechanism 25 that functions as this polishing head positioning mechanism.

The up-down movement mechanism 25 causes the polishing head 15 to be positioned at a predetermined height and a pressurized fluid is supplied to the pressure chambers D1 to D5 in this condition. The elastic film 21 receives the pressures in the pressure chambers D1 to D4, presses the wafer W against the polishing pad 11, and the retainer ring 22 receives the pressure in the pressure chamber D5 and presses the polishing pad 11. The wafer W is polished in this condition.

Figure 5:
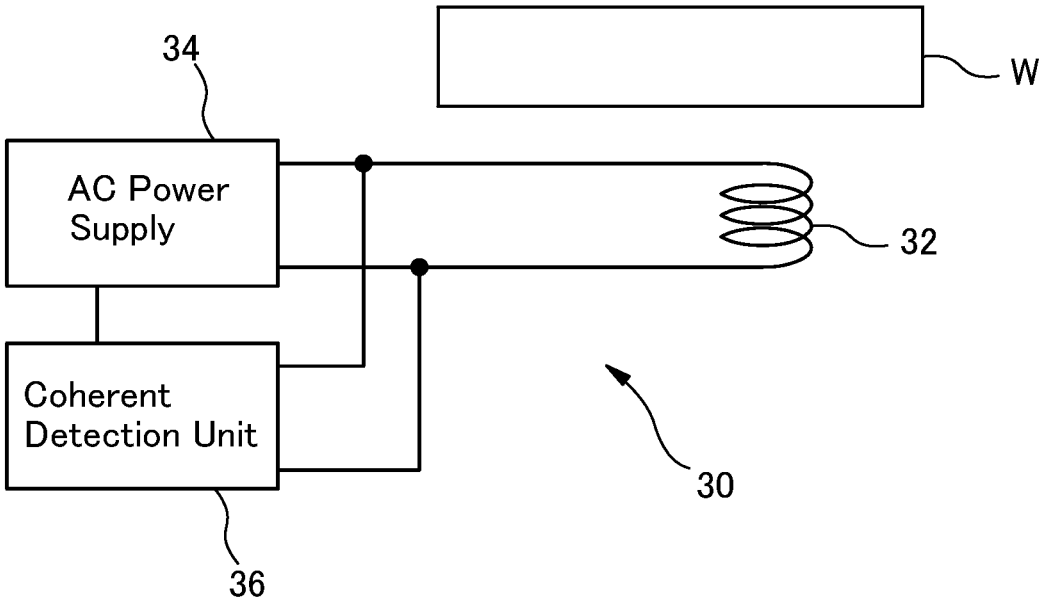
FIG. 5 is a block diagram illustrating a configuration of an eddy current sensor.

In FIG. 3, the polishing apparatus 10 is provided with an eddy current sensor 30 as a film thickness sensor that acquires a film thickness of the wafer W. As shown in FIG. 5, the eddy current sensor 30 is provided with a sensor coil 32 disposed in the polishing table 13, an AC power supply 34 and a coherent detection unit 36, both of which are connected to this sensor coil 32, and connected to the polishing control unit 12.

The sensor coil 32 composed of a plurality of coils forms a magnetic field by an AC current supplied from the AC power supply 34, generates an eddy current in a conductive film formed in the wafer W and detects a magnetic flux generated by the eddy current flowing through the conductive film. The coherent detection unit 36 is provided with a cos coherent detection circuit and a sin coherent detection circuit and detects impedance (a resistance component and an inductive reactance component) of an electric circuit including the sensor coil 32.

In FIG. 3, the polishing control unit 12 is provided with a film thickness estimation unit 40, an end point detection unit 42, an output correction unit 44, a reading unit 46, a memory 48 and a communication unit 50. The film thickness estimation unit 40 calculates a film thickness of the layer to be polished of the wafer W from the output (impedance) of the aforementioned eddy current sensor 30. Since the impedance detected by the eddy current sensor decreases as the film thickness of the layer to be polished on the wafer W decreases, it is possible to calculate the film thickness of the layer to be polished of the wafer W by monitoring a change in the impedance detected by the eddy current sensor 30.

The end point detection unit 42 compares data of a target value of a film thickness of a polishing target stored in the memory 48 with a measured value of the film thickness calculated by the film thickness estimation unit 40, and controls operation of the polishing head 15 so as to end polishing of the wafer W upon detecting that the measured value reaches the target value. The output correction unit 44 corrects an output value (measured value) from the eddy current sensor 30 and calculates an offset value necessary for correction. The reading unit 46 detects identification information (lot ID, wafer number) of the wafer W.

The memory 48 stores therein data such as a correction value of the sensor output, which will be described later, in addition to the target value of the film thickness of the layer to be polished, information on a film thickness index value with respect to the impedance of the layer to be polished and identification information of the wafer W as the polishing target. The communication unit 50 transmits/receives data such as an offset value, which will be described later, to/from the polishing management server 2 (see FIG. 1).

Figure 6:
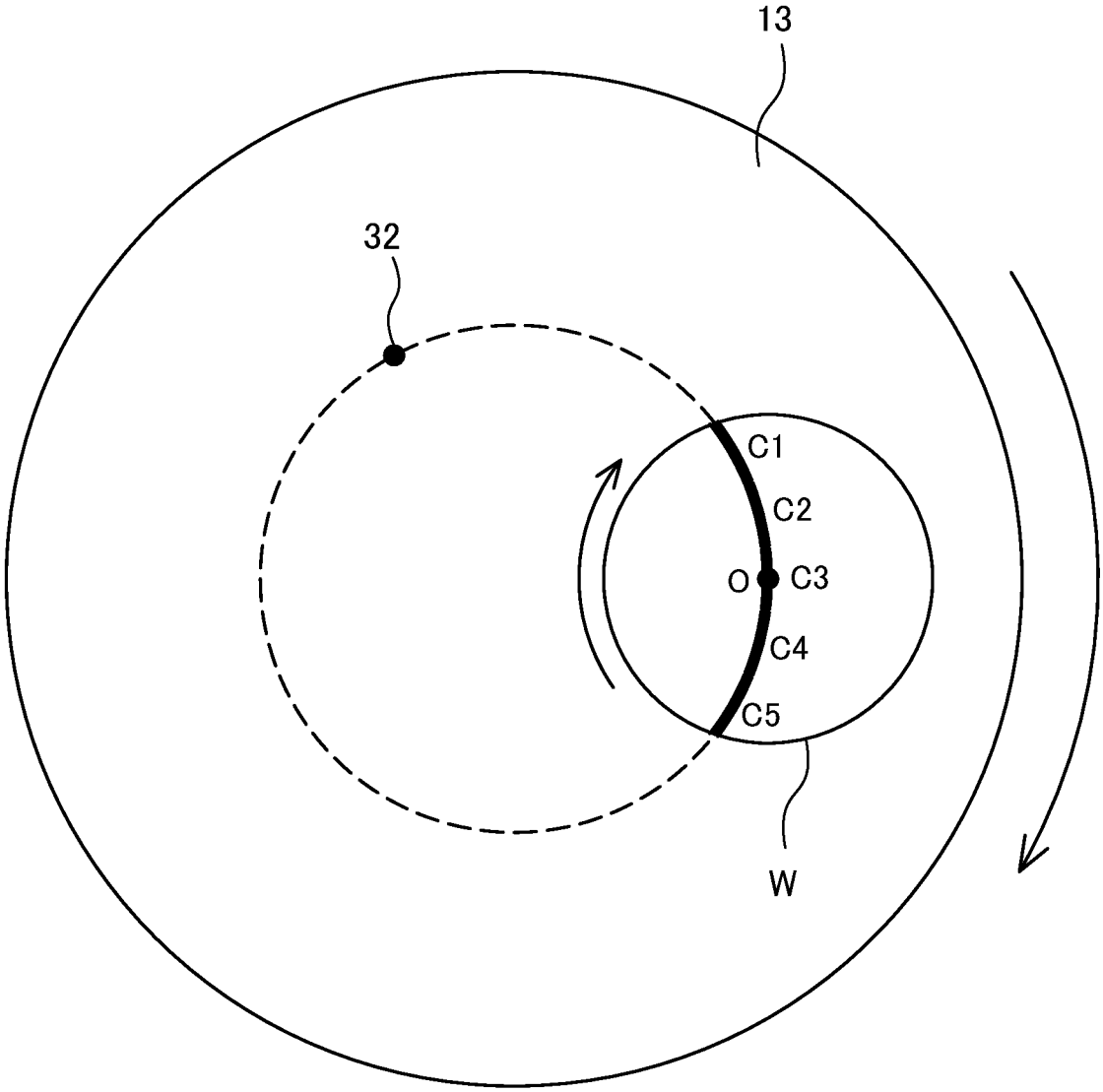
FIG. 6 is a plan view illustrating a positional relationship between a wafer and a polishing table.

FIG. 6 is a plan view illustrating a positional relationship between the wafer W and the polishing table 13. The eddy current sensor 30 is disposed at a position at which the eddy current sensor 30 passes a center O of the wafer W being polished and held to the polishing head 15 and detects the film thickness of the conductive film of the wafer W in a plurality of regions C1 to C5 including the center of the wafer W on the passing track (scanning line) while the polishing table 13 makes one rotation and passes below the wafer W. These regions C1 to C5 can be arbitrarily set within the surface of the substrate, and five regions are assumed in the present embodiment. However, the number of regions can be changed as appropriate. Measurement points in each region can also be set as appropriate, and, for example, four measurement points can be set in each region (a total of 20 measurement points for the regions C1 to C5).

Although the film thickness of the layer to be polished of the wafer W can be calculated from the output signal of the eddy current sensor 30, the output of the eddy current sensor 30 may vary under the influence of the metal material located in the underlayer of the layer to be polished. Particularly when the wafer W has a multilayered wiring structure, since the wafer W includes wiring (metal material) in the underlayer, the wiring in the underlayer may affect the output value of the eddy current sensor 30 and prevent accurate measurement of the film thickness.

For this reason, the substrate processing apparatus of the present embodiment is configured to remove influences of the wiring in the underlayer by correcting the output value from the eddy current sensor 30 in the second polishing apparatus 1B using the data of the output value of the eddy current sensor obtained through polishing (first polishing) of the layer to be polished by the first polishing apparatus 1A.

Figure 7:
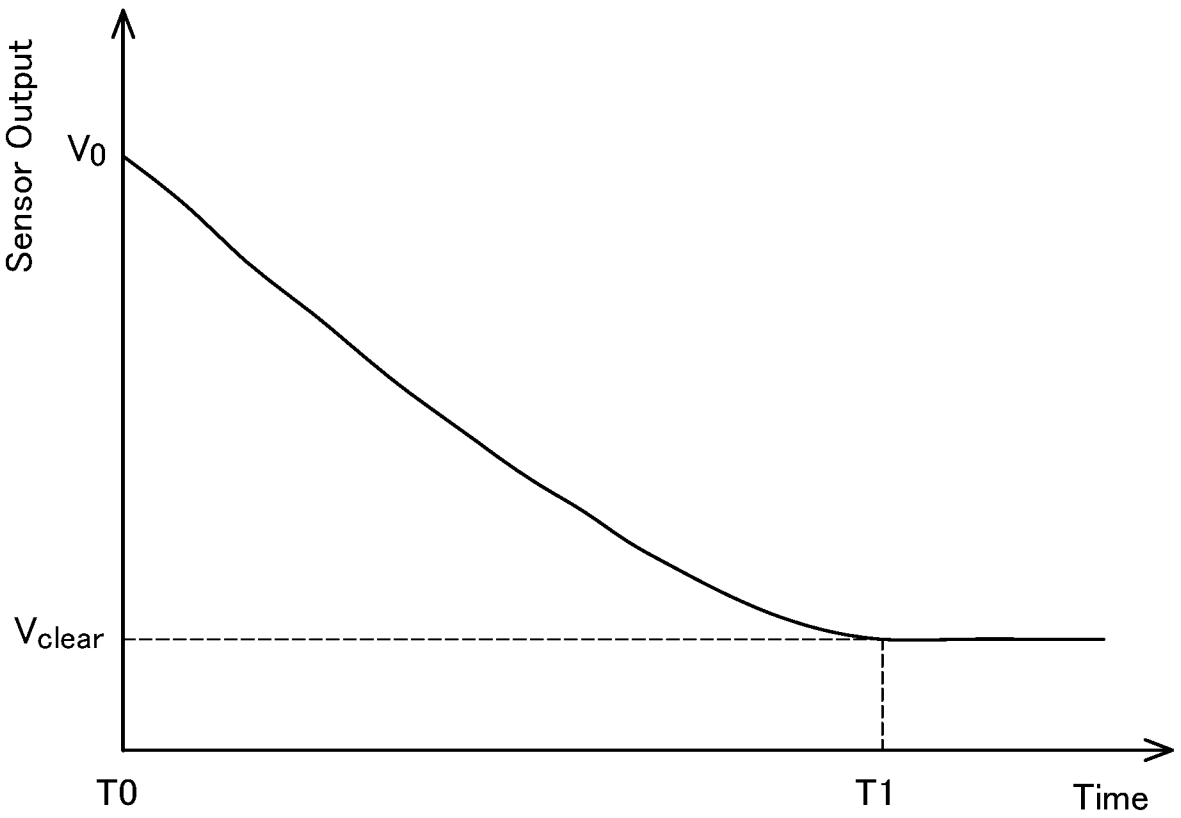
FIG. 7 is an explanatory drawing illustrating an example of sensor output of a first polishing apparatus.

FIG. 7 is a graph illustrating an example of time variation of the output value of the eddy current sensor 30 in the first polishing apparatus 1A, the horizontal axis representing time and the vertical axis representing the sensor output. Note that although a measured value in the central region C3 including the center O among the plurality of inspection regions C1 to C5 in FIG. 6 is shown in the present embodiment, measured values in other regions may also be used.

In FIG. 7, polishing of the wafer W is assumed to start at time T0 and the output value of the eddy current sensor 30 at that point in time is assumed to be V0. After that, the output value of the sensor gradually decreases as the polishing of the layer to be polished of the wafer W advances (as the film thickness of the layer to be polished decreases) and at time T1 when the entire layer to be polished is polished, the output value from the eddy current sensor 30 takes a substantially constant value of $V_{clear1}$. This output value $V_{clear1}$ is a value affected by the wiring in the underlayer of the layer to be polished of the wafer W.

Figure 8:
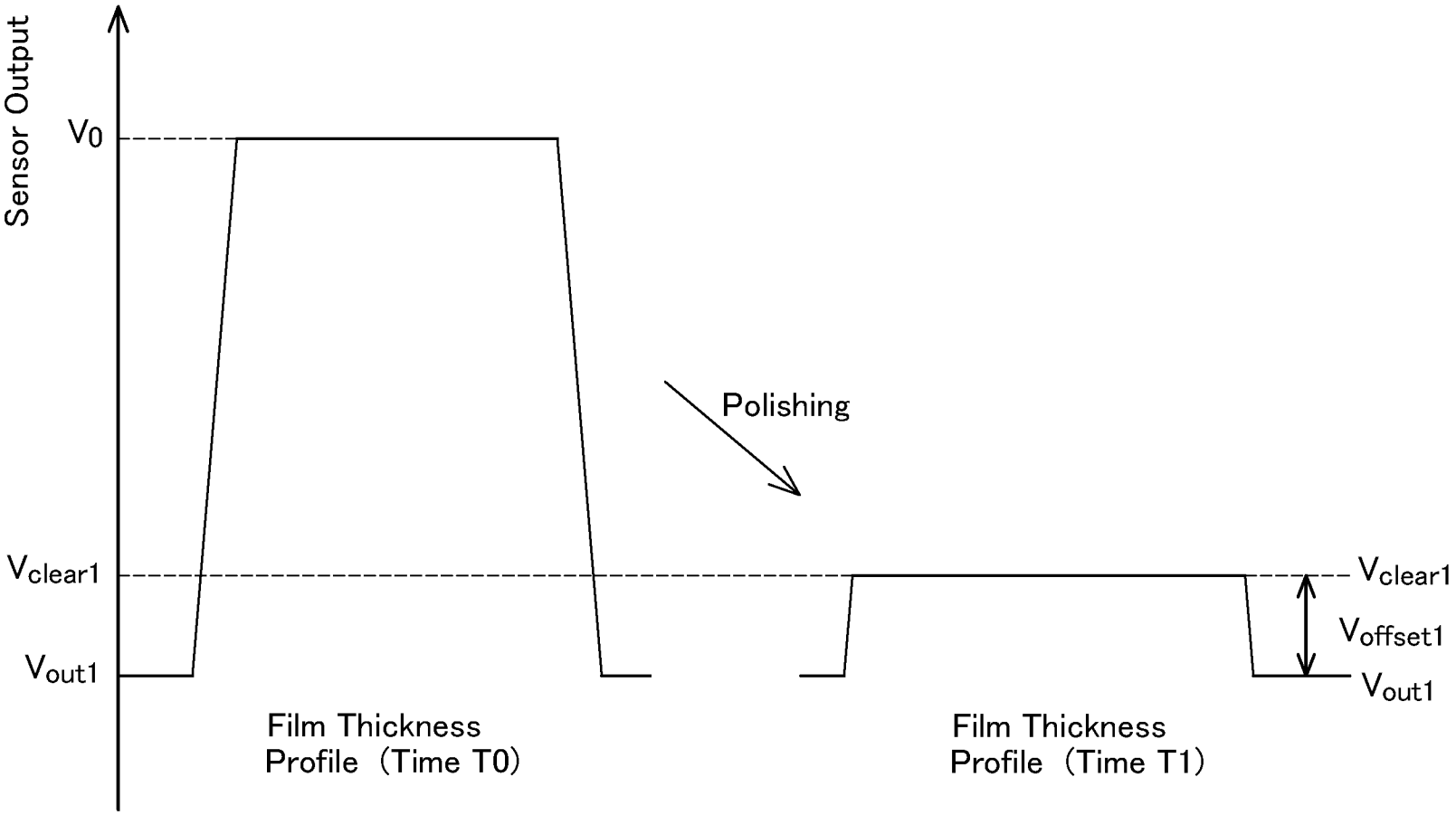
FIG. 8 is an explanatory drawing illustrating an example of a film thickness profile of the first polishing apparatus.

FIG. 8 illustrates an example of a distribution (profile graph) of the sensor output with respect to the diameter direction of the wafer corresponding to FIG. 7. In FIG. 8, the graph on the left side illustrates a distribution of the sensor output at an initial stage of polishing (time T0) and the graph on the right side illustrates a distribution at an end of polishing (when the entire region to be polished has been polished). In FIG. 8, $V_{OUT1}$ is a sensor output when the wafer W is not present, the output correction unit 44 calculates offset $V_{OFFSET1}$ by subtracting $V_{OUT1}$ from $V_{clear1}$, and stores this value in the memory 48 in association with the identification information of the wafer W. The communication unit 50 of the first polishing apparatus 1A transmits this offset $V_{OFFSET1}$ and corresponding data of identification information of the wafer W to the polishing management server 2.

Figure 9:
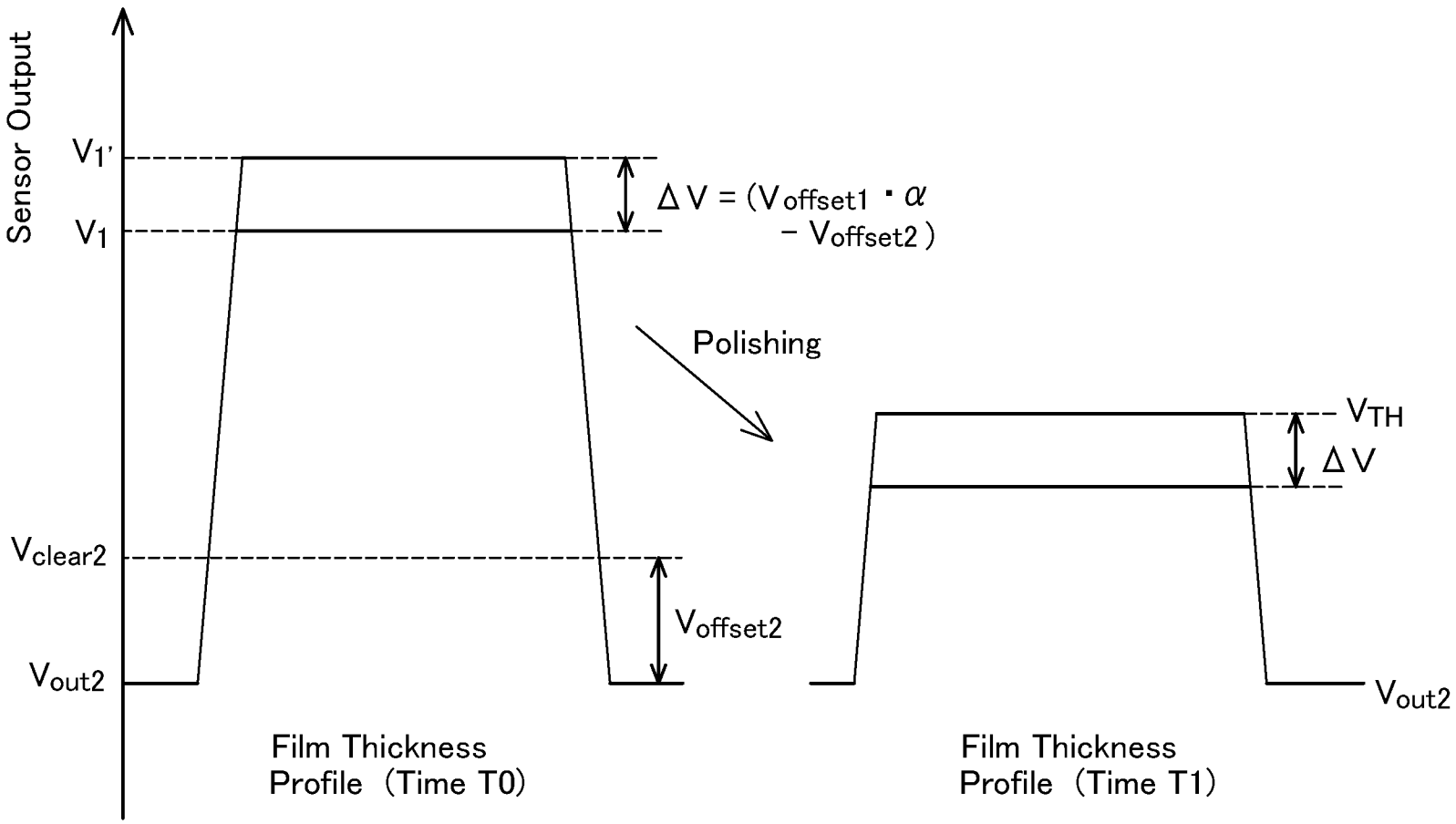
FIG. 9 is an explanatory drawing illustrating an example of a film thickness profile of a second polishing apparatus.

FIG. 9 illustrates an example of a distribution (profile graph) of sensor output with respect to the diameter direction of the wafer in the second polishing apparatus 1B. In FIG. 9, the graph on the left side shows a distribution of sensor output at an initial stage of polishing (time T0) and the graph on the right side shows a distribution at an end of polishing (when the film thickness of the layer to be polished has reached a predetermined value). In FIG. 9, $V_{OUT2}$ is a sensor output when the wafer W is not present on the eddy current sensor 30, $V_{clear2}$ is a sensor output when there is no layer to be polished (metal layer), and is calculated in advance at the time of sensor calibration of the apparatus or initial testing and stored in the memory 48.

The communication unit 50 of the second polishing apparatus 1B acquires the identification information of the wafer W and the corresponding data of offset $V_{OFFSET1}$ from the polishing management server 2 and stores the identification information and data in the memory 48. The output correction unit 44 of the second polishing apparatus 1B calculates an offset $V_{OFFSET2}$ by subtracting $V_{OUT2}$ from $V_{clear2}$ and calculates sensor correction value ΔV according to the following expression based on the offset $V_{OFFSET1}$ obtained in the first polishing apparatus 1A.

$$\Delta V=(V_{OFFSET1}\cdot\alpha-V_{OFFSET2})$$

In the above expression, α is a weight value and can be defined for each user in advance by initial testing of the apparatus or the like.

Figure 10:
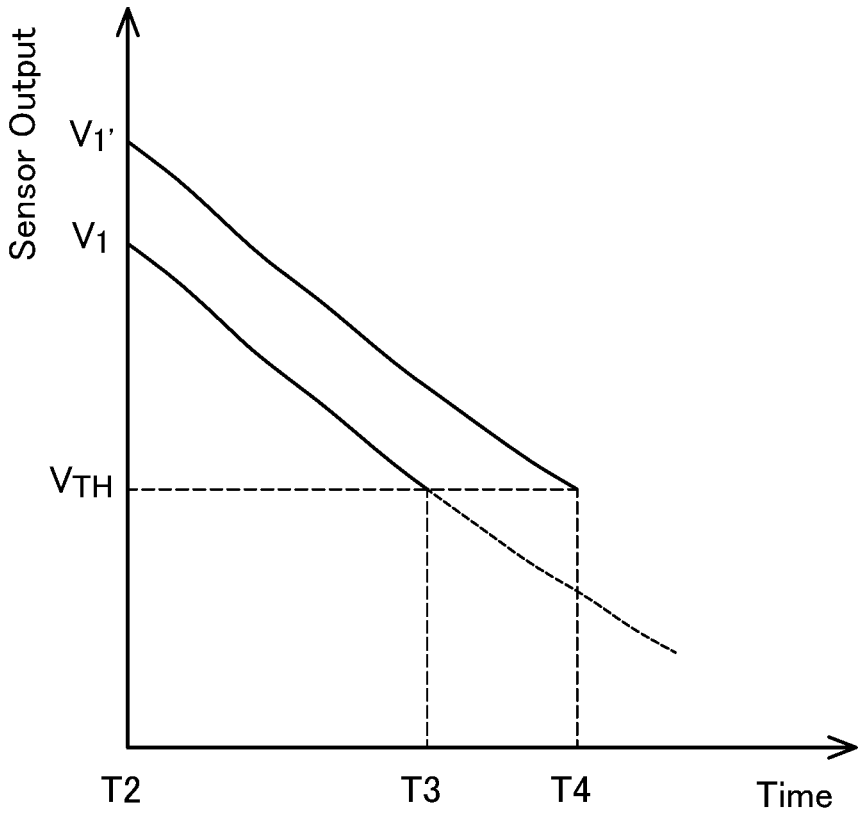
FIG. 10 is an explanatory drawing illustrating an example of sensor output of the second polishing apparatus.

FIG. 10 is a graph illustrating an example of an output value and a correction value of the eddy current sensor 30 in the second polishing apparatus 1B, the horizontal axis representing time and the vertical axis representing a sensor output (and correction value). Note that as in the case of the graph in FIG. 7, a measured value in the central region C3 including the center O among the plurality of inspection regions C1 to C5 in FIG. 6 is shown in the present embodiment.

In the graph in FIG. 10, polishing of the wafer W starts at time T2 and an output value (before correction) of the eddy current sensor 30 at that point in time is assumed to be V1. The output correction unit 44 of the second polishing apparatus 1B calculates V1' (=V1+ΔV) obtained by adding the aforementioned sensor correction value ΔV to the output value V1 of the eddy current sensor 30 as the corrected output value. The end point detection unit 42 ends the polishing of the wafer W at a point in time at which the corrected sensor output value reaches a set value.

In the graph in FIG. 10, as the polishing of the layer to be polished of the wafer W advances (as the film thickness of the layer to be polished decreases), the output value (and the correction value) of the sensor gradually decreases and the output value of the sensor reaches a target value $V_{TH}$ at time T3, but since the corrected output value does not reach the target value $V_{TH}$, the end point detection unit 42 of the second polishing apparatus 1B determines that substrate polishing has not ended yet and the polishing control unit 12 continues polishing the wafer W. After that, at time T4, when the corrected output value reaches the target value $V_{TH}$, the polishing control unit 12 ends the polishing of the wafer W. In this way, it is possible to prevent a variation in detection of the polishing end point under the influence of the underlayer of the layer to be polished.

Figure 11:
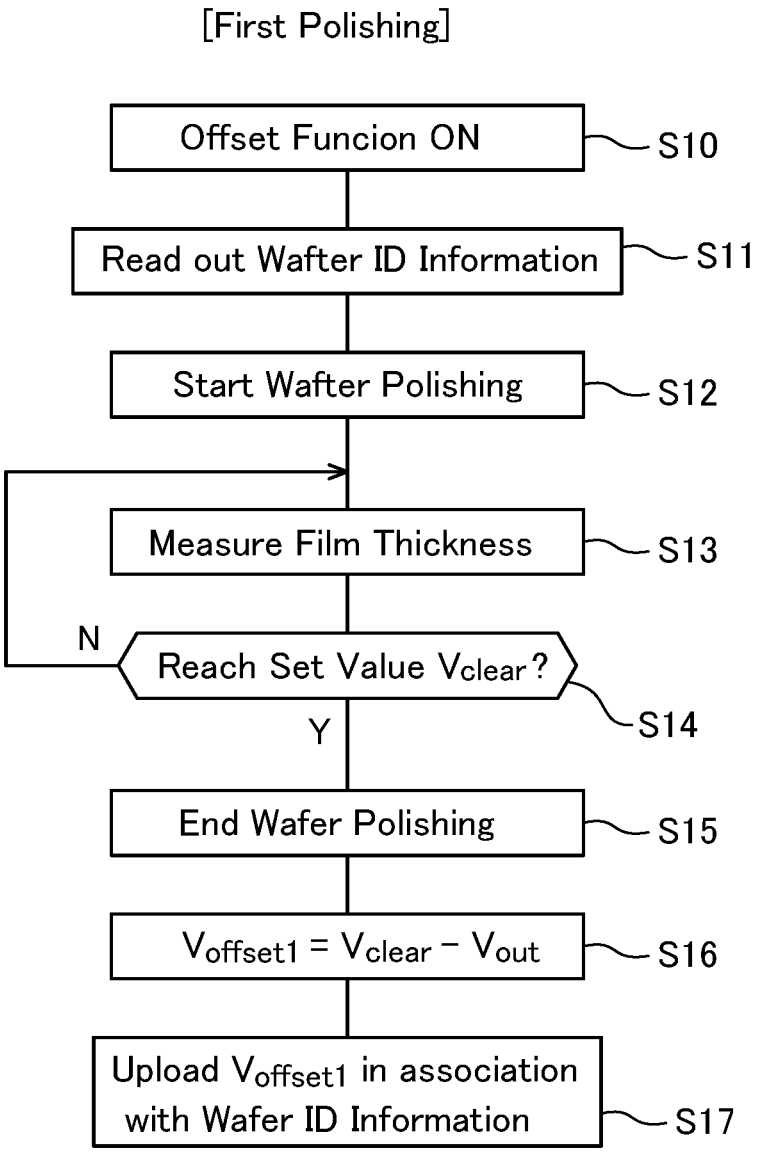
FIG. 11 is a flowchart illustrating an example of a procedure for substrate polishing processing of the first polishing apparatus.

FIG. 11 is a flowchart illustrating an example of substrate polishing processing by the first polishing apparatus 1A. When the offset function of the sensor output is turned on (step S10), the reading unit 46 of the first polishing apparatus 1A reads the information of the identification information (lot ID, wafer number) of the wafer to be polished and stores the information in the memory 48 (step S11). After that, a polishing recipe is set and wafer polishing starts (step S12).

During wafer polishing, the eddy current sensor 30 measures an impedance of the layer to be polished of the wafer W, the film thickness estimation unit 40 calculates a film thickness of the layer to be polished, and the film thickness is thereby measured (step S13). The end point detection unit 42 determines whether or not the measured value of the film thickness of the layer to be polished has reached the set value $V_{Clear1}$ (step S14), and if the measured value has reached the set value $V_{Clear1}$, the process ends the wafer polishing (step S15). On the other hand, if the measured value has not reached the set value $V_{Clear1}$, the process returns to step S13 and performs substrate polishing and film thickness measurement.

When the substrate polishing ends, the sensor correction unit 44 calculates an offset value $V_{OFFSET1}$ by subtracting $V_{OUT}$ from $V_{Clear1}$ (step S16), and uploads the offset value $V_{OFFSET1}$ to the polishing management server 2 via the communication unit 50 in association with the identification information of the wafer W stored in the memory 48 (step S17). It is thereby possible to use the offset value $V_{OFFSET1}$ affected by the base layer of the wafer W obtained in the first polishing for the second polishing.

Figure 12:
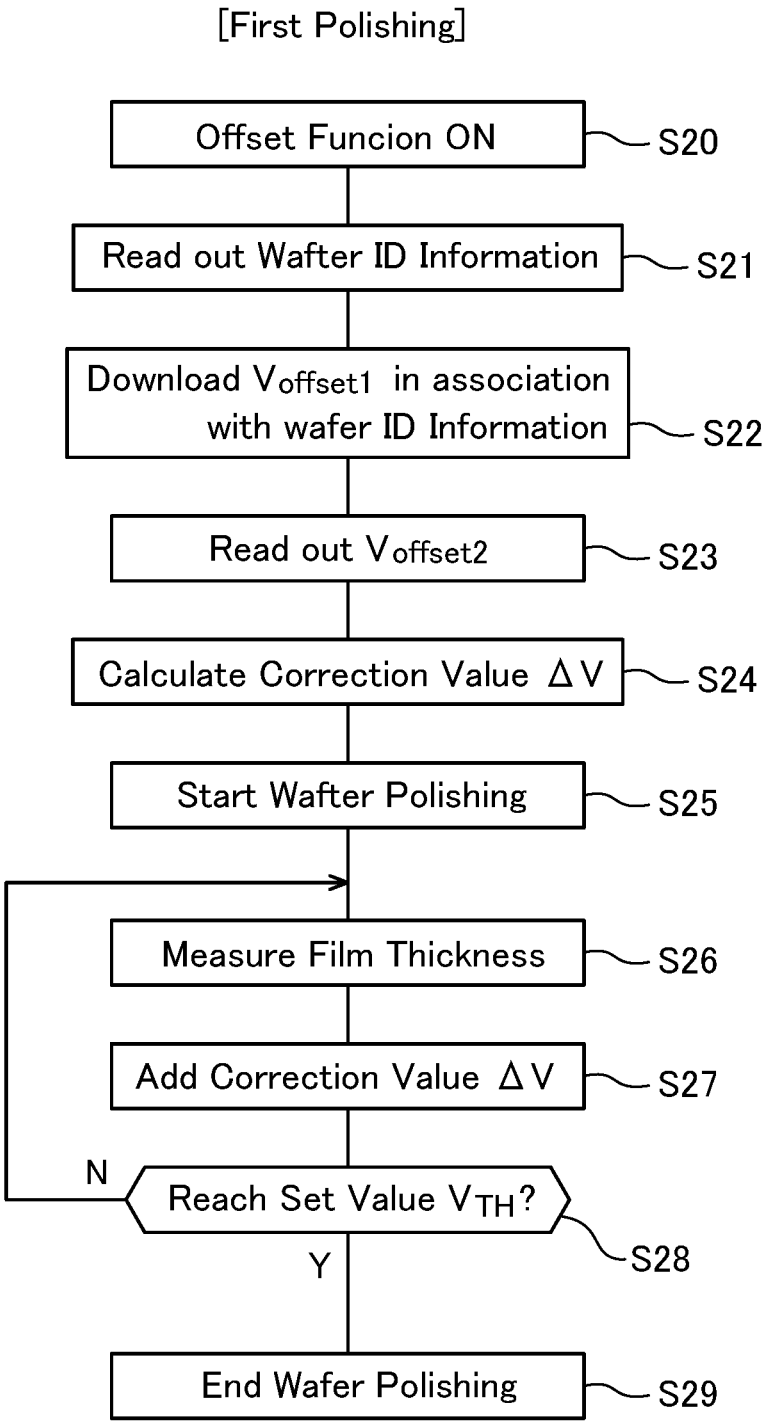
FIG. 12 is a flowchart illustrating an example of a procedure for substrate polishing processing of the second polishing apparatus.

FIG. 12 is a flowchart illustrating an example of substrate polishing processing by the second polishing apparatus 1B. When the offset function of the sensor output is turned on (step S20), the reading unit 46 reads identification information (lot ID, wafer number) of the wafer W to be polished (step S21). The sensor correction unit 44 of the second polishing apparatus 1A accesses the polishing management server 2 via the communication unit 50, downloads the offset value $V_{OFFSET1}$ stored in association with the identification information of the wafer W and stores the offset value $V_{OFFSET1}$ in the memory 48 (step S22).

After that, the sensor correction unit 44 of the second polishing apparatus 1A reads the other offset value $V_{OFFSET2}$ and weight value α stored in the memory 48 and calculates a sensor correction value ΔV (step S24). When reading of each parameter is completed and a polishing recipe is set, polishing of the wafer W starts (step S25).

During wafer polishing, the eddy current sensor 30 measures an impedance of the layer to be polished of the wafer W, the film thickness estimation unit 40 calculates a film thickness of the layer to be polished and the film thickness is thereby measured (step S26). The sensor correction unit 44 adds the aforementioned sensor correction value ΔV to the output value of the eddy current sensor 30 to correct the sensor output value (step S27). The end point detection unit 42 determines whether or not the corrected sensor output value (the correction value with the influence of the base layer taken into account) has reached the set value $V_{TH}$ (step S28), and ends the wafer polishing if the corrected sensor output value has reached the set value $V_{TH}$ (step S29). On the other hand, if the corrected sensor output value has not reached the set value $V_{TH}$, the process returns to step S26 and substrate polishing and film thickness measurement are performed.

In the above embodiment, the eddy current sensor has been described as an example but the present invention is not limited to the eddy current sensor and the present invention is likewise applicable to an optical sensor (a wafer is irradiated with light, a spectrum of reflected light thereof is detected and a film thickness of the layer to be polished of the wafer W is thereby detected).

Figure 13:
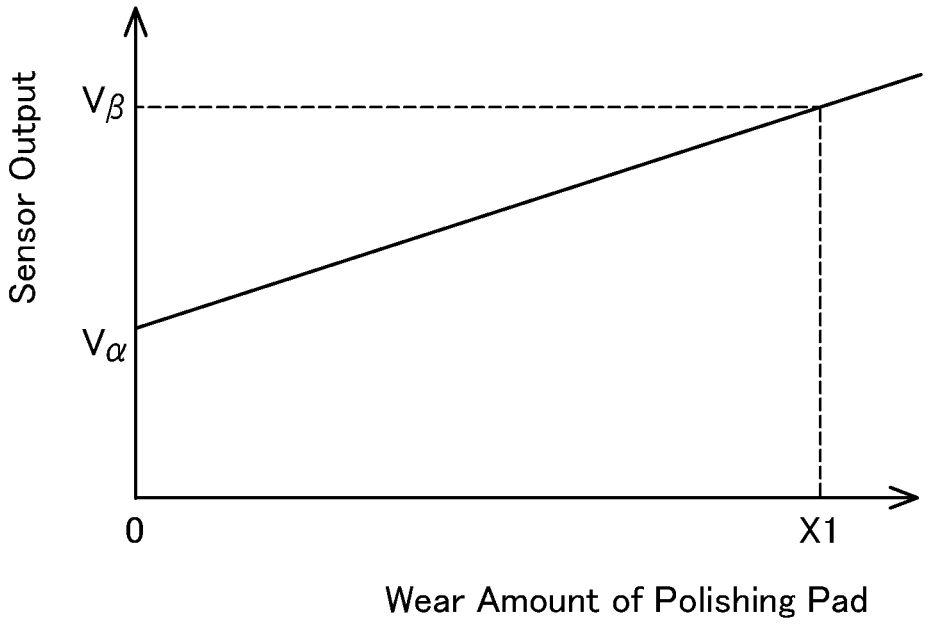
FIG. 13 is a graph illustrating a relationship between an amount of wear of a polishing pad and sensor output.

Furthermore, an amount of wear of the polishing pad 13*a* can also be taken into account when determining a set value (set value to end polishing) of the sensor output in second polishing. FIG. 13 is a graph illustrating a relationship between a sensor output value and an amount of wear of the polishing pad when the film thickness of the layer to be polished is a predetermined value (known value). When the amount of wear is 0 (brand-new polishing pad), the sensor output is Vα and the sensor output increases as the polishing pad is then worn (that is, as a distance between the eddy current sensor 30 and the wafer W decreases), and the sensor output becomes VP when the amount of wear is X1.

Based on the graph in FIG. 13, the relationship between the sensor value and the amount of wear of the polishing pad is approximated by, for example, a straight line and then stored in the memory 48, the thickness of the pad (amount of wear) is measured at the time of actual polishing and a threshold $V_{TH}$ of the sensor output is calculated. Thus, the film thickness of the wafer W can be measured with the amount of wear of the polishing pad taken into account and polishing end can be detected more accurately.

The aforementioned embodiment has been described in order that a person possessing ordinary knowledge in the technical field to which the present invention belongs can implement the present invention. Various modifications of the above embodiment can be naturally made by those skilled in the art and the technical thought of the present invention is also applicable to other embodiments. The present invention is not limited to the described embodiment, but can be interpreted in the broadest scope conforming to the technical thought defined by the scope of the patent claims.

What is claimed is:

1. A substrate polishing system comprising a first substrate polishing apparatus and a second substrate polishing apparatus, each of which comprises a film thickness sensor for measuring a film thickness of a layer to be polished of a substrate and performing polishing the layer to be polished by pressing the substrate against a polishing pad, wherein the first substrate polishing apparatus outputs a difference, as a first offset value, between an output value of the film thickness sensor when an underlayer of the layer to be polished is exposed and an output value of the film thickness sensor when the substrate is not present, the first offset value being associated with the identification information of the substrate, wherein the second substrate polishing apparatus comprises:

a memory configured to store information of the first offset value;

a controller in communication with the memory, the controller configured to correct the output value from the film thickness sensor based on the first offset value associated with the same identification information of the substrate that is measured by the film thickness sensor of the second substrate polishing apparatus; and output a control signal indicating an end point of substrate polishing when a measured value of the film thickness of the layer to be polished calculated based on the corrected output value reaches a target value.

2. The substrate polishing system according to claim 1, wherein the second substrate polishing apparatus stores a difference, as a second offset value, between the output value of the film thickness sensor when the underlayer of the layer to be polished is exposed and the output value of the film thickness sensor when the substrate is not present, the second offset value being stored in the storage unit, and wherein the controller is configured to correct the output value from the film thickness sensor based on the first offset value and the second offset value.

3. The substrate polishing system according to claim 2, wherein the second substrate polishing apparatus corrects the output value from the film thickness sensor by adding to the output value from the film thickness sensor, a correction value calculated by the following expression:

$$\Delta V=(V_{OFFSET1}\cdot\alpha-V_{OFFSET2})$$

where, $V_{OFFSET1}$ is the first offset value, $V_{OFFSET2}$ is the second offset value and α is a weight value.

4. The substrate polishing system according to claim 1, wherein the second substrate polishing apparatus corrects the target value based on an amount of wear of the polishing pad.

5. The substrate polishing system according to claim 1, further comprising a polishing management server that stores identification information of the substrate in association with the first offset value, wherein the first substrate polishing apparatus transmits the first offset value in association with the identification information of the substrate to the polishing management server, and wherein the controller is configured to acquire the identification information of the substrate to be polished and acquires the first offset value corresponding to the identification information from the polishing management server.

6. The substrate polishing system according to claim 1, wherein the film thickness sensor is an eddy current sensor.

7. A substrate polishing method for sequentially polishing layers to be polished using a first substrate polishing apparatus and a second substrate polishing apparatus, each of which comprises a film thickness sensor for measuring a film thickness of the layers to be polished of a substrate and polishing the layers to be polished by pressing the substrate against a polishing pad, wherein the first substrate polishing apparatus outputs a difference, as a first offset value, between an output value of the film thickness sensor when an underlayer of the layer to be polished is exposed and an output value of the film thickness sensor when the substrate is not present, the first offset value being associated with the identification information of the substrate, wherein the second substrate polishing apparatus:

stores information of the first offset value in a memory;

corrects an output value from the film thickness sensor based on the first offset value associated with the same identification information of the substrate that is measured by the film thickness sensor of the second substrate polishing apparatus; and outputs a control signal indicating an end point of substrate polishing when a measured value of the film thickness of each of the layers to be polished calculated based on the corrected output value reaches a target value.

8. A substrate polishing apparatus comprising:

a polishing head for polishing a layer to be polished by pressing a substrate comprising the layer to be polished against a polishing pad;

a film thickness sensor for measuring a film thickness of the layer to be polished;

a memory that stores therein information indicating a difference, as a first offset value, between an output value of the film thickness sensor when an under layer of the layer to be polished is exposed and an output value of the film thickness sensor when the substrate is not present in past polishing of the layer to be polished, the first offset value being associated with the identification information of the substrate;

a controller in communication with the memory, the controller configured to correct the output value from the film thickness sensor based on the first offset value associated with the same identification information of the substrate that is measured by the film thickness sensor of the second substrate polishing apparatus; and output a control signal indicating an end point of substrate polishing when a measured value of the film thickness of the layer to be polished based on the corrected output value reaches a target value.

* * * * *